US011708133B2

(12) United States Patent
Jouvion et al.

(10) Patent No.: US 11,708,133 B2
(45) Date of Patent: Jul. 25, 2023

(54) DEVICE FOR RECOVERING A WATER VEHICLE

(71) Applicant: NAVAL GROUP, Paris (FR)

(72) Inventors: Eric Jouvion, Lorient (FR); Pierre-Alan Michel, Lorient (FR); Eric Perrot, Lorient (FR)

(73) Assignee: NAVAL GROUP, Paris (FR)

( * ) Notice: Subject to any disclaimer, the term of this patent is extended or adjusted under 35 U.S.C. 154(b) by 142 days.

(21) Appl. No.: 17/293,028

(22) PCT Filed: Nov. 15, 2019

(86) PCT No.: PCT/EP2019/081548
§ 371 (c)(1),
(2) Date: May 11, 2021

(87) PCT Pub. No.: WO2020/099665
PCT Pub. Date: May 22, 2020

(65) Prior Publication Data

US 2021/0394869 A1 Dec. 23, 2021

(30) Foreign Application Priority Data

Nov. 16, 2018 (FR) ..... 18 71907

(51) Int. Cl.
*B63B 23/38* (2006.01)
*B63B 23/36* (2006.01)
(Continued)

(52) U.S. Cl.
CPC ..... *B63B 23/38* (2013.01); *B63B 23/36* (2013.01); *B63B 27/36* (2013.01); *B66C 13/02* (2013.01)

(58) Field of Classification Search
CPC ..... B63B 23/30; B63B 23/36; B63B 23/38; B63B 27/36; B66C 13/02
(Continued)

(56) References Cited

U.S. PATENT DOCUMENTS 4,697,533 A * 10/1987 Bordreuil ..... B63B 35/40 114/344
5,641,242 A 6/1997 Riviere
(Continued)

FOREIGN PATENT DOCUMENTS

DE 19500182 A1 7/1996
FR 2556309 A1 6/1985
WO WO 97/39940 A1 10/1997

OTHER PUBLICATIONS

International Search Report and Written Opinion of the International Searching Authority for International Application No. PCT/EP2019/081548 (with English translation of International Search Report only), dated Dec. 20, 2019, in 12 pages.
(Continued)

*Primary Examiner* — Daniel V Venne
(74) *Attorney, Agent, or Firm* — Knobbe, Martens, Olson & Bear, LLP

(57) ABSTRACT

The recovery device comprises a floating cradle configured to receive and support the vehicle, the cradle having an entrance for the vehicle situated at a rear end of the cradle and delimited between two lateral portions, the cradle being configured or capable of being configured with a rear lateral extension extending toward the rear from one of the two lateral portions, the other lateral portion having no rear lateral extension.

18 Claims, 1 Drawing Sheet

(51) Int. Cl.
*B63B 27/36* (2006.01)
*B66C 13/02* (2006.01)

(58) Field of Classification Search
USPC ..... 114/259, 263
See application file for complete search history.

(56) References Cited

U.S. PATENT DOCUMENTS

| | | | | |
|---|---|---|---|---|
| 6,152,065 | A * | 11/2000 | Gronstrand | B63B 23/30 405/1 |
| 6,178,914 | B1 * | 1/2001 | Axelsson | B63B 27/36 114/248 |
| 7,506,606 | B2 * | 3/2009 | Murphy | B63B 27/10 114/248 |
| 8,821,066 | B1 | 9/2014 | Caccamo et al. | |
| 2018/0312225 | A1 | 11/2018 | Peleg et al. | |

OTHER PUBLICATIONS

Search Report for French Application No. 1871907, dated Aug. 23, 2019, in 2 pages.

* cited by examiner

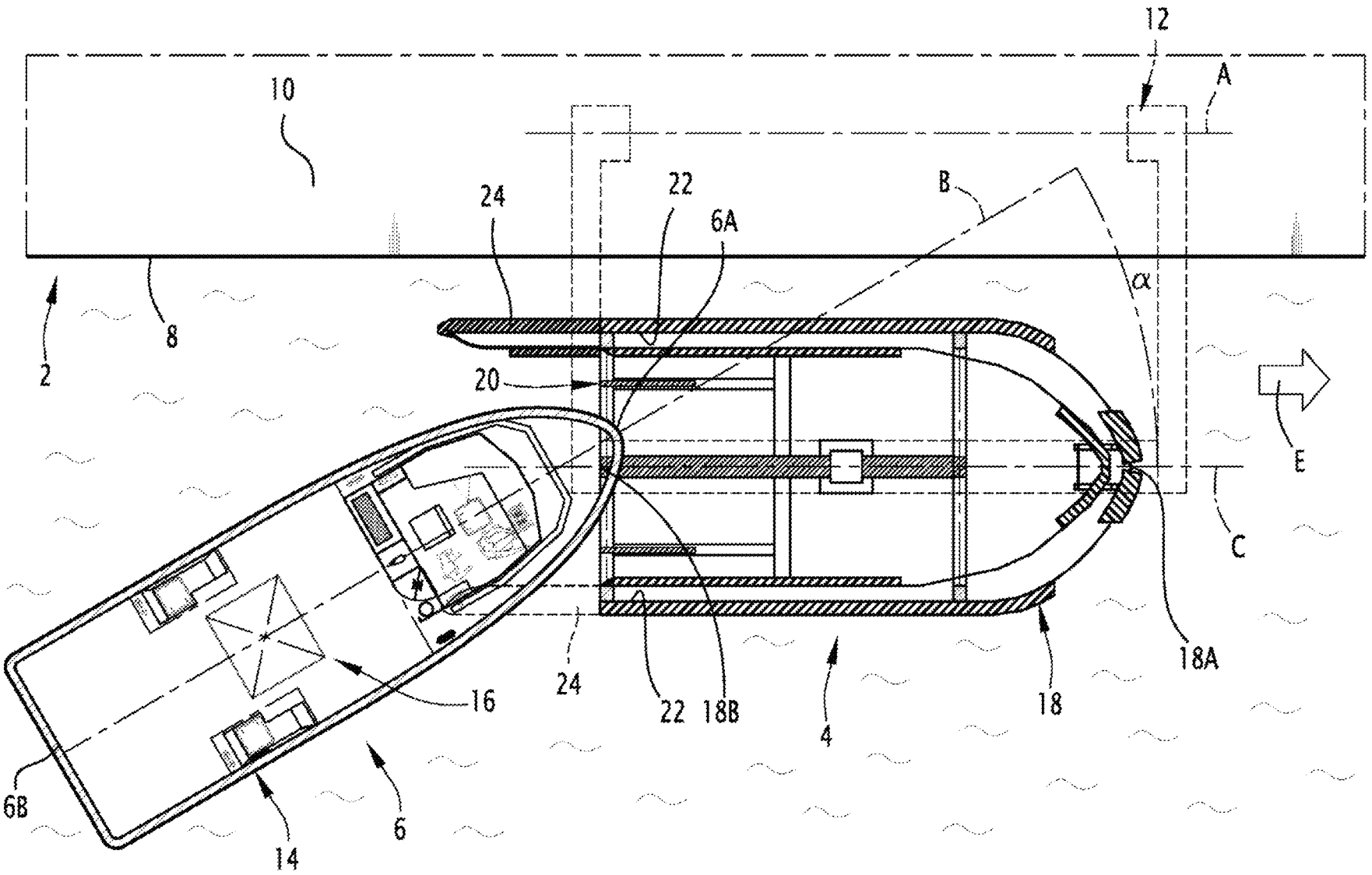
E
C
A
12
α
18A
18
B
4
6A
22
18B
22
24
20
24
16
6
10
14
8
2
6B

DEVICE FOR RECOVERING A WATER VEHICLE

CROSS-REFERENCE TO RELATED APPLICATIONS

This application is the U.S. National Phase under 35 U.S.C. § 371 of International Application PCT/EP2019/081548, filed Nov. 15, 2019, which claims priority to FR Application No. 18 71907, filed Nov. 16, 2018, the entire contents of each of which are incorporated by reference herein and made a part of this specification.

TECHNICAL FIELD

The present invention relates to a device for recovering a vehicle, for example an unmanned surface vessel (USV) or an unmanned underwater vessel (UUV), also called an unmanned autonomous vehicle (UAV).

BACKGROUND

WO97/39940A1 and FR2556309A1 propose devices for placing a vehicle in the water and recovering a vehicle comprising a floating cradle (also called "floating cage" or "floating dock") configured to receive and support the vehicle, the floating cradle being configured to be handled using a lifting means provided on a ship or a floating platform or a fixed installation, so as to be lowered into the water from the ship, the floating platform or the fixed installation to place the vehicle in the water, or raised onto the ship, the floating platform or the fixed installation, to recover the vehicle.

During vehicle recovery operations, the floating cradle is placed in the water, the vehicle reenters the cradle, then the cradle is raised onto the ship, the floating platform or the fixed installation.

However, it may prove difficult to get the vehicle into the cradle, due to the swell, in particular on heavy seas and/or when the vehicle must be raised onto a moving ship, due to inevitable relative movements between the ship, the floating platform or the fixed installation, the cradle placed in the water and the vehicle.

SUMMARY

One aim of the invention is to propose a device for recovering a vehicle which facilitates the recovery operation.

To this end, the invention proposes a device for recovering a vehicle, the recovery device comprising a floating cradle configured to receive and support the vehicle, the cradle having an entrance for the vehicle situated at a rear end of the cradle and delimited between two lateral portions, the cradle being configured or capable of being configured with a rear lateral extension extending toward the rear from one of the two lateral portions, the other lateral portion having no rear lateral extension.

The rear lateral extension extending from one of the two lateral portions delimiting the entrance of the cradle makes it possible to guide the bow (or stem) of a vehicle seeking to enter the cradle, by making it possible for the vehicle to approach the cradle obliquely, such that the stem comes into contact with the rear lateral extension and is deflected toward the entrance of the cradle.

The entrance of the vehicle into the cradle is then made easier, since it is no longer necessary to align the longitudinal axis of the vehicle with that of the cradle to be able to cause the vehicle to enter the cradle.

According to specific embodiments, the recovery device comprises one or several of the following optional features, considered individually or according to all technically possible combinations: it comprises at least one rear lateral extension configured to be mounted removably on the cradle; it comprises two rear lateral extensions configured to be mounted removably on the cradle, each rear lateral extension being configured to be mounted on one respective lateral portion among the two lateral portions delimiting the entrance of the cradle; it comprises a rear lateral extension configured to be mounted removably on the cradle, selectively on one lateral portion or on the other lateral portion among the two lateral portions delimiting the entrance of the cradle; and the or each rear lateral extension has a length, taken along a longitudinal axis of the cradle, greater than or equal to ⅙ of the length of the cradle taken between the entrance and the front end of the cradle.

The invention also relates to a ship equipped with a recovery device as defined above.

The invention also relates to a method for recovering a vehicle using a recovery device as defined above, the vehicle being controlled to advance toward the entrance of the cradle from the side of the cradle opposite the side where the rear lateral extension is located and being oriented obliquely relative to the cradle such that the bow of the vehicle comes into contact with the rear lateral extension and is deflected by the rear lateral extension toward the entrance of the cradle.

According to specific embodiments, the recovery method comprises one or more of the following optional features, considered individually or according to any technically possible combinations: the cradle is placed in the water next to a moving ship; the cradle is placed in the water on the starboard side of the ship, the rear lateral extension being located on the port side of the cradle, the vehicle being controlled to approach the cradle by the starboard side of the cradle; and the cradle is placed in the water on the port side of the ship, the rear lateral extension being located on the starboard side of the cradle, the vehicle being controlled to approach the cradle by the port side of the cradle.

BRIEF DESCRIPTION OF THE DRAWINGS

The invention and its advantages will be better understood upon reading the following description, provided solely as a non-limiting example, and done in reference to the appended drawing, in which FIG. 1 is a schematic top view of a ship provided with a device for recovering a vehicle, the recovery device being in a first configuration.

DETAILED DESCRIPTION

The ship 2 illustrated in FIG. 1 is equipped with a recovery device 4 making it possible to recover a vehicle 6 in order to raise it onto the ship 2. The recovery device can advantageously also be used to place the vehicle in the water from the ship 2.

The ship 2 is illustrated partially in FIG. 1; only a starboard side 8 and part of a deck 10 of the ship 2 are visible. The ship 2 is for example moving forward along a direction of advance E.

The ship 2 is equipped with a lifting means 12 (shown in dotted lines in FIG. 1) making it possible to handle the recovery device 4 from the ship 2.

The lifting means 12 is for example mounted on the deck 10 of the ship 2 while being tilted about a horizontal axis A between a retracted position (not shown) in which the lifting means 12 makes it possible to handle loads above the deck 10 and a deployed position (illustrated in dotted lines in FIG. 1) in which the lifting means 12 protrudes outside the ship, past the gunwale, to raise or lower loads located next to the ship 2.

As illustrated in FIG. 1, the lifting means 12 is in the deployed position and the recovery device 4 is placed in the water next to the ship 2, on the starboard side.

The vehicle 6 is for example a surface vehicle or an underwater vehicle, such an underwater vehicle also being able to float and to move on the surface of the water, in particular during a maneuver for placement in the water or a recovery maneuver.

The vehicle 6 is for example an unmanned vessel, in particular an unmanned surface vessel (USV) or an unmanned underwater vessel (UUV), also called an unmanned autonomous vehicle (UAV). In a variant, the vehicle 6 is a manned surface vehicle or a manned underwater vessel.

The vehicle 6 has a longitudinal axis B and has a bow 6A (front part of the vehicle 6) and a stern 6B (rear part of the vehicle 6) which are spaced apart along this longitudinal axis B.

The vehicle 6 preferably comprises a propulsion system 14 ensuring the propulsion of the vehicle 6. The propulsion system 14 for example comprises one or several engine(s) and/or one or several propeller(s).

The vehicle 6 preferably comprises a steering system 16 making it possible to steer the vehicle 6. The steering system 16 for example comprises one or several rudder(s). In a variant or as an optional addition, the steering system 16 is configured to allow the orientation of at least part of the propulsion system 14, for example the orientation of one or several propeller(s).

The recovery device 4 comprises a cradle 18 configured to receive the vehicle 6 and to support it.

The cradle 18 is buoyant. Thus, it floats when it is placed in the water. Such a floating cradle 18 is also called "floating cage" or "floating dock".

When the vehicle 6 is received in the cradle 18, the cradle 18 is able to be handled to remove the vehicle 6 from the water or to place it in the water, the vehicle 6 being carried by the cradle 18.

The cradle 18 extends along a longitudinal axis C and has a front end 18A and a rear end 18B which are spaced apart along this longitudinal axis C of the cradle 18.

The cradle 18 is configured so that the vehicle 6 on the surface of the water can enter the cradle 18 floating on the surface of the water through the rear end 18B of the cradle 18, i.e., from back to front.

The cradle 18 is provided to receive the vehicle 6 with the longitudinal axis B of the vehicle 6 substantially aligned with the longitudinal axis C of the cradle 18, the bow 6A of the vehicle 6 being adjacent to the front end 18A of the cradle 18 and the stern 6B of the vehicle 6 being adjacent to the rear end 18B of the cradle 18.

The cradle 18 has, at its rear end 18B, an entrance 20 allowing the vehicle 6 to enter the cradle 18 when the cradle 18 is floating on the water.

The cradle 18 has two lateral portions 22 delimiting the entrance 20 of the cradle 18 between them. The two lateral portions 22 in particular make it possible to guide the vehicle 6 laterally when it enters the cradle 18.

The cradle 18 is configured or capable of being configured such that it has a rear lateral extension 24 extending longitudinally toward the rear from only one of the lateral portions 22 delimiting the entrance 20.

The rear lateral extension 24 extends toward the rear from one of the lateral portions 22 substantially along the longitudinal axis C of the cradle 18.

One lateral portion 22 is provided with the rear lateral extension 24, the other lateral portion 22 having no such rear lateral extension.

The rear lateral extension 24 extends longitudinally toward the rear past the entrance 20.

The rear lateral extension 24 extends the lateral portion 22 on which it is positioned toward the rear of the cradle 18, from the entrance 20.

As illustrated in FIG. 1, the cradle 18 provided with the rear lateral extension 24 has, in top view, an asymmetrical shape relative to a vertical median plane passing through the longitudinal axis C of the cradle 18, this asymmetrical shape being imparted by the rear lateral extension 24.

The side of the cradle 18 whose lateral portion 22 is provided with the rear lateral extension 24 extends further toward the rear than the side of the cradle 18 deprived of rear lateral extension.

The lateral portions 22 of the cradle 18 extend symmetrically on either side of the median plane. In particular, the lateral portions 22 have the same length, taken along the longitudinal axis C of the cradle 18.

The asymmetry of the cradle 18 is imparted by the rear lateral extension 24, which extends one of the lateral portions 22 toward the rear of the cradle 18, the other lateral portion 22 not being extended.

The rear lateral extension 24 preferably has a length, taken along the longitudinal axis C of the cradle 18, greater than or equal to ⅙ of the length of the lateral portion 22 of the cradle 18. The length of the lateral portion 22 of the cradle 18 is taken along the longitudinal axis C of the cradle 18, between the entrance 20 and the front end 18A of the cradle 18.

The cradle 18 is advantageously configured to prevent the vehicle 6 from exiting at the front end 18A of the cradle 18. To do this, for example, the cradle 18 narrows toward its front end 18A and/or is closed at its front end 18A.

Advantageously, the cradle 18 is carinated and has a hull extending along the longitudinal axis C of the cradle 18. Such a hull decreases the resistance to forward movement and the wake of the cradle 18 when the cradle 18 is placed in the water on the side of the ship 2 which advances on the water.

As illustrated in FIG. 1, the rear lateral extension 24 is provided on the port-side lateral portion 22 of the cradle 18, i.e., the lateral portion 22 located on the left of the cradle 18 when looking toward the front of the cradle 18, and the cradle 18 is placed in the water on the starboard side of the ship 2. Thus, the rear extension 24, which is located on the port side of the cradle 18, is located on the lateral portion 22 of the entrance 20 of the cradle 18 which is adjacent to the ship 2.

During operation, in order to recover the vehicle 6, the cradle 18 is placed in the water using the lifting means 12 next to the ship 2, here on the starboard side. The cradle 18 is kept on the side, for example using the lifting means 12 and/or cables for example connecting the front end of the cradle 18 to the ship 2.

The cradle 18 follows the route of the ship 2. The vehicle 6 is steered toward the entrance 20 of the cradle 18 while approaching from the starboard side, following a route converging with that of the cradle 18, i.e., while advancing along a movement direction forming a non-zero angle with that of the cradle 18 and approaching the ship 2. In FIG. 1, the longitudinal axis B of the vehicle 6 forms a non-zero angle $\alpha$ with the longitudinal axis C of the cradle 18. In particular, the propulsion system 14 and the steering system 16 of the vehicle 6 are steered to follow such a route toward the cradle 18 placed in the water.

The vehicle 6 is thus steered so as to arrive from the rear and obliquely relative to the cradle 18, on the side of the entrance 20 of the cradle opposite the rear lateral extension 24, such that its bow 6A comes into contact with the rear lateral extension 24 of the cradle 18. The rear lateral extension 24 then guides the vehicle 6 by deflecting the bow 6A of the vehicle 6 toward the entrance 20 of the cradle 18. The rear lateral extension 24 of the cradle 18 is therefore configured to guide the bow 6A of the vehicle 6 toward the entrance 20 of the cradle 18.

Once the vehicle 6 is received inside the cradle 18, the cradle 18 carrying the vehicle 6 is lifted out of the water and brought back onto the ship 2, in particular onto the deck 10, using the lifting means 12.

Thus, the presence of the rear lateral extension 24 facilitates the entrance of the vehicle 6 into the cradle 18 during the recovery of the vehicle 6.

This entrance of the vehicle 6 can indeed be made difficult due to the swell, which causes relative movements of the ship 2, the cradle 18 and the vehicle 6 which are difficult to predict and control, in particular when the sea is heavy.

Furthermore, in order to recover the vehicle 6 without interrupting the forward movement of the ship 2, it is desirable to recover the vehicle 6 while the ship 2 is advancing. Now, when the ship 2 is advancing, it creates suction which tends to attract any floating object located near the ship 2 on the side thereof, toward the ship 2. Thus, the vehicle 6 approaching from the side of the moving ship 2 tends to be attracted toward the ship 2. The rear lateral extension 24 located on the cradle 18 on the side of the ship 2 makes it possible to guide the vehicle 6 toward the entrance 22 while preventing it from going toward the ship 2.

Lastly, when it advances, the ship 2 creates a wake which assumes the form of a cone of transverse and divergent waves (wake commonly called "Kelvin" wake), which tends to disrupt any floating object located near the ship 2. The rear lateral extension 24 located on the cradle 18 on the side of the ship 2 makes it possible to adopt an oblique approach route of the vehicle 6 with respect to the ship 2, so as to avoid the disruptive wake zones created by the ship 2.

In FIG. 1, the rear lateral extension 24 is provided on the lateral portion 22 located on the port side of the cradle 18 in order to perform a recovery of the vehicle 6 on the starboard side of the ship 2.

In another example embodiment, and as illustrated in mixed lines in FIG. 1, the rear lateral extension 24 of the cradle 18 is provided on the lateral portion 22 located on the starboard side of the cradle 18, the cradle 18 then having no rear lateral extension on the lateral portion 22 located on the port side of the cradle 18, for example to perform a recovery of the vehicle 6 on the port side of the ship 2.

In one example embodiment, a cradle 18 is provided with a rear lateral extension 24 mounted to be irremovable on one of the lateral portion 22 located on the port side of the cradle 18 and the lateral portion 22 located on the starboard side of the cradle 18, the lateral portion 22 located on the other side of the cradle 18 having no rear lateral extension.

In a first example embodiment which can be illustrated by FIG. 1, the cradle 18 is provided with a rear lateral extension 24 mounted to be irremovable on the lateral portion 22 located on the port side of the cradle 18, the lateral portion 22 located on the starboard side of the cradle 18 having no rear lateral extension.

In a second example embodiment which can be illustrated by the mixed lines in FIG. 1, the cradle 18 is provided with a rear lateral extension 24 mounted to be irremovable on the lateral portion 22 located on the starboard side of the cradle 18, the lateral portion 22 located on the port side of the cradle 18 having no rear lateral extension.

In another example embodiment, the cradle 18 is provided with at least one rear lateral extension 24 mounted to be removable on the cradle 18. The removable rear lateral extension 24 can be disassembled and removed from the cradle 18.

The cradle 18 is then configurable, each rear lateral extension 24 being able to be mounted on the cradle 18 or disassembled from the cradle 18.

In one example embodiment, the cradle 18 has two rear lateral extensions 24 mounted removably on the cradle 18, namely a port-side rear lateral extension 24 and a starboard-side rear lateral extension 24, the cradle 18 being configurable by removing one of the rear lateral extensions 24 and maintaining the other one on the cradle 18, for example in order to recover a vehicle 6 on one side or the other side of an advancing ship 2.

In one example embodiment, the cradle 18 has a rear lateral extension 24 which is configured to be mounted removably, selectively on the lateral portion 22 located on the port side of the cradle 18 or on the lateral portion 22 located on the starboard side of the cradle 18.

The recovery device 4 has been described above in a use on a ship 2, in particular to recover a vehicle 6 while the ship 2 is moving forward.

The recovery device 4 can be used while the ship 2 is not in motion.

Providing the rear lateral extension 24 facilitates the entrance of the vehicle 6, including when the cradle 18 is immobile, by allowing the entrance of the vehicle 6 into the cradle 18 with a non-zero angle between the longitudinal axis B of the vehicle 6 and the longitudinal axis C of the cradle 18.

The recovery device 4 can also be used on an immobile floating platform or a fixed installation fastened to the ground or to the seabed.

The recovery device 4 can also be used to place a vehicle 6 in the water, for example from a ship, a floating platform or a fixed installation.

To do this, the vehicle 6 being carried by the cradle 18 mounted on board the ship or the floating platform or on the fixed installation, the cradle 18 is placed in the water and the vehicle 6 is steered to leave the cradle 18, in reverse and through the entrance 20 of the cradle 18.

Such an operation can be done from a moving ship.

Thus, the recovery device constitutes a device for recovering a vehicle and/or placing a vehicle in the water.

What is claimed is:

1. A recovery device for recovering a water vehicle, the recovery device comprising a floating cradle configured to receive and support the water vehicle, the floating cradle having an entrance for the water vehicle situated at a rear end of the floating cradle and delimited between two lateral portions, the floating cradle being configured to have a rear lateral extension extending from the rear end of the floating cradle from one of the two lateral portions, wherein a longitudinal extent of the rear lateral extension is aligned with and extends from a longitudinal extent of the one of the two lateral portions along a longitudinal axis of the floating cradle, and wherein an other lateral portion of the two lateral portions has no rear lateral extension.

2. The recovery device according to claim 1, wherein the rear lateral extension is configured to be mounted removably on the floating cradle.

3. The recovery device according to claim 1, wherein the rear lateral extension is configured to be mounted removably on the floating cradle, selectively on one lateral portion or on the other lateral portion among the two lateral portions delimiting the entrance of the floating cradle.

4. The recovery device according to claim 1, wherein the rear lateral extension has a length, taken along a longitudinal axis of the floating cradle, greater than or equal to ⅙ of the length of the floating cradle taken between the entrance and a front end of the floating cradle.

5. A ship equipped with a recovery device according to claim 1.

6. A method for recovering a water vehicle using a recovery device according to claim 1, the water vehicle being controlled to advance toward the entrance of the floating cradle from a side of the floating cradle opposite an other side of the floating cradle where the rear lateral extension is located and being oriented obliquely relative to the floating cradle such that a bow of the water vehicle comes into contact with the rear lateral extension and is deflected by the rear lateral extension toward the entrance of the floating cradle.

7. The recovery method according to claim 6, wherein the floating cradle is placed in water next to a moving ship.

8. The recovery method according to claim 7, wherein the floating cradle is placed in the water on a starboard side of the ship, the rear lateral extension being located on a port side of the floating cradle, the water vehicle being controlled to approach the floating cradle by the starboard side of the floating cradle.

9. The recovery method according to claim 7, wherein the floating cradle is placed in the water on a port side of the ship, the rear lateral extension being located on a starboard side of the floating cradle, the water vehicle being controlled to approach the floating cradle by the port side of the floating cradle.

10. A recovery device for recovering a water vehicle, the recovery device comprising a floating cradle configured to receive and support the water vehicle, the floating cradle having an entrance for the water vehicle situated at a rear end of the floating cradle and delimited between two lateral portions, the floating cradle being configured to have a rear lateral extension extending from the rear end of the floating cradle from one of the two lateral portions, wherein an outside surface of the rear lateral extension extends from an outside surface of the one of the two lateral portions, the outside surfaces facing outwardly from the floating cradle, and wherein an other lateral portion of the two lateral portions has no rear lateral extension.

11. The recovery device according to claim 10, wherein the rear lateral extension is configured to be mounted removably on the floating cradle.

12. The recovery device according to claim 10, wherein the rear lateral extension is configured to be mounted removably on the floating cradle, selectively on one lateral portion or on the other lateral portion among the two lateral portions delimiting the entrance of the floating cradle.

13. The recovery device according to claim 10, wherein the rear lateral extension has a length, taken along a longitudinal axis of the floating cradle, greater than or equal to ⅙ of the length of the floating cradle taken between the entrance and a front end of the floating cradle.

14. A ship equipped with a recovery device according to claim 10.

15. A method for recovering a water vehicle using a recovery device according to claim 10, the water vehicle being controlled to advance toward the entrance of the floating cradle from a side of the floating cradle opposite an other side of the floating cradle where the rear lateral extension is located and being oriented obliquely relative to the floating cradle such that a bow of the water vehicle comes into contact with the rear lateral extension and is deflected by the rear lateral extension toward the entrance of the floating cradle.

16. The recovery method according to claim 15, wherein the floating cradle is placed in water next to a moving ship.

17. The recovery method according to claim 16, wherein the floating cradle is placed in the water on a starboard side of the ship, the rear lateral extension being located on a port side of the floating cradle, the water vehicle being controlled to approach the floating cradle by the starboard side of the floating cradle.

18. The recovery method according to claim 16, wherein the floating cradle is placed in the water on a port side of the ship, the rear lateral extension being located on a starboard side of the floating cradle, the water vehicle being controlled to approach the floating cradle by the port side of the floating cradle.

* * * * *